US006315390B1

(12) United States Patent
Fujii et al.

(10) Patent No.: US 6,315,390 B1
(45) Date of Patent: Nov. 13, 2001

(54) LINE INK JET HEAD AND A PRINTER USING THE SAME

(75) Inventors: Masahiro Fujii; Yuji Kawase; Atsushi Yamaji, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/542,599

(22) Filed: Apr. 4, 2000

(30) Foreign Application Priority Data

Apr. 5, 1999 (JP) ..... 11-097629

(51) Int. Cl.[7] ..... B41J 2/155; B41J 29/38; B41J 2/14; B41J 2/16

(52) U.S. Cl. ..... 347/42; 347/13; 347/49

(58) Field of Search ..... 347/42, 13, 48, 347/44, 68, 49

(56) References Cited

U.S. PATENT DOCUMENTS

| | | | |
|---|---|---|---|
| 4,463,359 | 7/1984 | Ayata et al. | 347/43 |
| 5,257,043 | 10/1993 | Kneezel | 347/43 |
| 5,821,951 | 10/1998 | Fujii et al. | 347/43 |
| 5,933,163 | 7/1999 | Koizumi et al. | 347/42 |

FOREIGN PATENT DOCUMENTS

| | | |
|---|---|---|
| 0 670 222 A2 | 9/1995 | (EP) . |
| A-58-63462 | 4/1983 | (JP) . |
| 58038170 | 5/1983 | (JP) . |
| B-3-58917 | 6/1991 | (JP) . |
| A-7-241991 | 9/1995 | (JP) . |
| A-8-127137 | 5/1996 | (JP) . |
| A-10-9511 | 4/1998 | (JP) . |
| 11020175 | 1/1999 | (JP) . |

*Primary Examiner*—Thinh Nguyen
(74) *Attorney, Agent, or Firm*—Nixon & Vanderhye P.C.

(57) ABSTRACT

A line ink jet head having a plurality of ink jet head units in a staggered pattern enables the staggered ink jet head units to be easily precisely positioned to each other. The line ink jet head has ink jet head units that are staggered to each other in line with the ink nozzles disposed to the first and second head mounting surfaces on both sides of a head unit mounting layer. If the head unit mounting surface is precisely formed, the ink jet heads can be precisely positioned in staggered rows by simply bonding the ink jet head units to respective mounting surfaces.

15 Claims, 9 Drawing Sheets

LINE INK JET HEAD AND A PRINTER USING THE SAME

TECHNICAL FIELD

The present invention relates to a line ink jet head used as an ink jet head in a line printer. More particularly, the present invention relates to an on-demand type line ink jet head comprising an arrangement of a plurality of identically structured ink jet head units.

BACKGROUND

An ink jet device comprising a line ink jet head of this type is taught, for example, in Japanese Examined Patent Application (kokoku) 3-58917. An ink jet device as taught in the cited application comprises a line ink jet head having a plurality of ink jet head units, each having a plurality of ink nozzles, arranged in series in line with the ink nozzle arrangement (that is, in the line printing direction).

The ink jet head units 10(n) (where n is an integer of one or more with only ink jet head units 10(1) and 10(2) shown in FIG. 13) are arranged in line as shown in FIG. 13 and bonded together end to end. The ink nozzles 11(m) (where m is an integer of one or more) arrayed in line in the line printing direction must be spaced with the same pitch p between every nozzle. The last and first (i.e., endmost) ink nozzles 11(128) and 11(1) in adjacent ink jet head units 10(1) and 10(2) must also be placed at this same pitch p. This means that the thickness of the wall separating the ink chambers communicating with the ink nozzles 11(1) and 11(128) at the ends of each ink jet head unit, that is, the adjacent end walls 12(1) and 12(128) of the ink jet head units, must be half the thickness of the wall separating the ink chambers communicating with the other ink nozzles.

Changing the wall thickness, however, means that the rigidity of the end walls is less than the rigidity of the other internal ink chamber dividers, and the ink discharge characteristic of the ink nozzles associated with these end ink chambers differs from the discharge characteristic of the other internal ink nozzles. This is undesirable because a difference in ink discharge characteristics lowers print quality.

Furthermore, as noted above the ink jet head units are bonded together at the outside of these end walls. This means that the end walls must be finished with good precision. This, however, makes manufacturing that much more difficult, and is thus undesirable.

These problems can be resolved by arranging the ink nozzles of the ink jet head units in a staggered pattern as taught in Japanese Unexamined Patent Application (kokai) 8-127137.

A problem with a staggered arrangement of ink nozzles in the ink jet head units is that positioning the inkjet head units to each other becomes more difficult. Imprecise alignment of the ink jet head units results in lower print quality, and is thus obviously undesirable. In addition, no method for precisely and easily aligning ink jet head units to each other has yet been proposed.

When using a staggered ink nozzle arrangement it is also necessary to adjust the ink nozzle drive timing between ink jet head units so that the ink drops ejected from different ink nozzles are placed on the same line on the print medium. Therefore, when the line ink jet head comprises a plurality of ink jet head units with a staggered ink nozzle array, the circuitry needed to adjust the drive timing is more complex compared with the drive circuitry of a line ink jet head having the ink nozzles in a straight line.

SUMMARY

In general, in one aspect, the invention features a line ink jet head having a plurality of ink jet head units, each having a plurality of ink nozzles formed in a line, arranged in the direction of the ink nozzle line, includes a head unit mounting layer, a head unit mounting surface formed on at least one side of this head unit mounting layer, a plurality of the ink jet head units affixed in a staggered pattern in the direction of the ink nozzle line on the head unit mounting surface, and a common ink supply path formed in the head unit mounting layer for supplying ink to each ink jet head unit. Each ink jet head unit includes an ink nozzle surface in which the ink nozzles are formed; and a mounting reference surface for affixing the ink jet head unit to the head unit mounting surface, the mounting reference surface being orthogonal to the ink nozzle surface and parallel to the direction of the ink nozzle line.

The ink jet head units can be precisely aligned to each other in staggered rows by means of simply bonding the mounting reference surface of each ink jet head unit to a head unit mounting surface formed on the head unit mounting layer.

In an implementation, the head unit mounting surface is first and second head unit mounting surfaces parallel to each other with a specific interval therebetween and formed on different surfaces of the head unit mounting layer. An odd numbered inkjet head unit is bonded to each first head unit mounting surface, and an even numbered ink jet head unit is bonded to each second head unit mounting surface.

In another implementation, the first and second head unit mounting surfaces can be formed on the same side of the head unit mounting layer 2. The first head unit mounting surfaces are formed at a specific interval on this surface of the head unit mounting layer. Between first head unit mounting surfaces is a protrusion protruding a specific distance from the surface of the head unit mounting layer. The second head unit mounting surfaces are then formed on these protrusions.

In an implementation, the inkjet head is an electrostatic drive type. An electrostatic drive type ink jet head unit comprises an ink pressure chamber communicating with an ink nozzle, and an electrostatic drive mechanism for changing the volume of the ink pressure chamber using electrostatic force to discharge ink drops from the ink nozzles as a result of this volume change.

To further downsize this electrostatic drive type ink jet head unit, the ink jet head unit preferably has laminated first, second, and third substrates bonded to each other. A common ink chamber communicating with the common ink path is formed in the first substrate. The ink nozzles and ink pressure chamber are formed between the first and second substrates. The electrostatic drive mechanism is preferably formed between the second and third substrates.

In another implementation, the side of the first substrate opposite the side thereof to which the second substrate is bonded, or the side of the third substrate opposite the side thereof to which the second substrate is bonded, is the mounting reference surface.

To avoid requiring complex circuitry for adjusting the drive timing of the staggered ink jet head units in a line ink jet head according to the present invention, the distance between offset ink nozzle lines in the staggered ink jet head units is an integer multiple of the base resolution of a printed image.

In another aspect, the invention features a printer having a line ink jet head, a form transportation mechanism for transporting a print medium; and an ink supply mechanism for supplying ink to the line ink jet head. The line ink jet head is disposed covering a printing area of a print medium transported by the form transportation mechanism.

By printing to a print medium by means of the line ink jet head while transporting thereby a print medium, a printer according to the invention can print at high speed without requiring a complex drive circuit, and is simple to manufacture.

An advantage of the present invention is to provide a line ink jet head whereby ink jet head units having a staggered ink nozzle array can be positioned to each other easily with good precision.

A further advantage of the present invention is to provide a line ink jet head in which the drive timing of the ink jet head units having a staggered ink nozzle array can be adjusted without making the drive circuitry complex.

The details of one or more embodiments of the invention are set forth in the accompanying drawings and the description below. Other features, objects, and advantages of the invention will be apparent from the description and drawings, and from the claims.

Key to the figures

1 line ink jet head

2 head unit mounting layer

21 ink supply path

3, 4 head unit mounting surfaces

5, 5(1)–5(5) ink jet head units

5*a* ink nozzle surface

Figure 1:
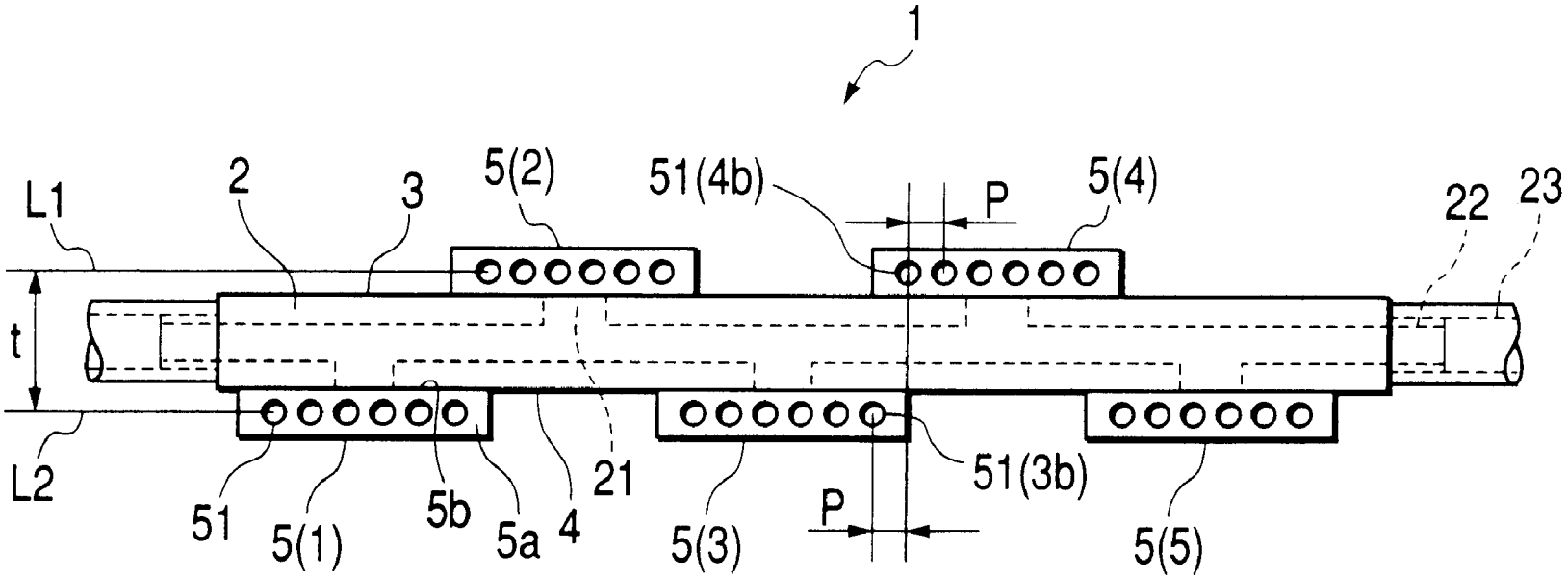
FIG. 1 is a front view of an embodiment of a line ink jet head.

5*b* reference surface for ink jet head unit mounting (back)

51 ink nozzle

51 (3*b*), 51 (4*b*) endmost ink nozzles p nozzle pitch t distance between ink nozzle rows

30 printer control circuit

55 ink chamber

59 diaphragm

66 end walls of the ink jet head unit

67 ink chamber dividing walls

101 line ink jet head

102 head unit mounting layer

103, 103(1), 103(2) first head mounting surface

104, 104(1), 104(2) second head mounting surface

105, 105(1) to 105(4) ink jet head unit

121 common ink supply path

132 ink nozzle surface

133 ink nozzle

134 ink pressure chamber

135 ink supply ports common ink chamber

141 glass electrode layer

142 cavity layer

143 nozzle layer

143*a* reference surface for mounting

150 printer

151 line ink jet head

155 form transportation mechanism

157 ink supply mechanism

Text in the figures

FIG. 3 higher order device (main computer, scanner, network) 32 raster data converter (hardware: gate array) 33 motor driver, other I/O printer control circuit 30 head driver 34 inkjet head unit 5(1)–5(5)

line ink jet head 35

Like reference symbols in the various drawings indicate like elements.

DETAILED DESCRIPTION

FIG. 1 is a front view of a line ink jet head according to a first preferred embodiment of our invention. As shown in FIG. 1, this line ink jet head 1 comprises a head unit mounting layer 2 of a specific thickness, parallel flat head unit mounting surfaces 3 and 4 formed on both sides of the head unit mounting layer 2, and a total five ink jet head units 5 (5(1) to 5(5)) mounted on these head unit mounting surfaces 3 and 4.

In this exemplary embodiment, two ink jet head units 5(2) and 5(4) are disposed to one head unit mounting surface 3, and the other three ink jet head units 5(1), 5(3), and 5(5) are disposed to the other head unit mounting surface 4. Each of the ink jet head units are fastened to the head unit mounting layer 2 by means of adhesive. The inkjet head units 5(1) to 5(5) are further identical in structure with a flat, rectangular parallelepiped shape. A plurality of ink nozzles 51 is arrayed along the width of the ink nozzle surface 5*a* (the front surface) of each ink jet head unit 5. Note that the ink nozzle surface 5*a* has a horizontally long rectangular profile. Back 5*b* of each ink jet head unit 5(1) to 5(5) is orthogonal to the ink nozzle surface 5*a*, flat, and parallel to the ink nozzle 51 line. This back 5*b* is the reference surface for mounting the ink jet head unit 5 to the head unit mounting layer 2.

The inkjet head units 5(1) to 5(5) are bonded at the back 5*b* (mounting reference surface) thereof to the head unit mounting surfaces 3 and 4 staggered with a constant gap therebetween on opposite sides of the head unit mounting layer 2 as shown in FIG. 1. Therefore, by precisely manufacturing the head unit mounting layer 2 with a constant mounting layer 2 thickness, that is, a constant gap between head unit mounting surfaces 3 and 4, and precisely manufacturing the inkjet head units so that the distance from the ink jet head unit mounting reference surface, i.e., back 5*b*, to the ink nozzles 51 is constant, staggered ink jet head units 5(1) to 5(5) can be precisely positioned and aligned by simply bonding the ink jet head units 5(1) to 5(5) to the head unit mounting surfaces 3 and 4.

Next, staggered adjacent ink jet head units 5(3) and 5(4) are positioned to each other in the ink nozzle line direction (i.e., the line printing direction) so that the end ink nozzle 51 (3*b*) of the one ink jet head unit 5(3) and the end ink nozzle 51 (4*b*) of the other ink jet head unit 5(4) are at the same nozzle pitch (pitch p) as the pitch p between ink nozzles within each ink jet head unit. The other staggered ink jet head units are likewise positioned. As a result, the nozzle pitch is the same pitch p between all nozzles of the line ink jet head 1 when seen in the ink nozzle line direction (i.e., the print line direction).

Furthermore, the distance t between center line L1 through the ink nozzles of the ink jet head units 5(2) and 5(4) on head unit mounting surface 3, and center line L2 through the ink nozzles of the ink jet head units 5(1), 5(3) and 5(5) on head unit mounting surface 4, is an integer multiple of pitch p.

A common ink supply path 21 is formed inside the head unit mounting layer 2. An ink tube 23 is connected to the ink supply opening 22 formed at an end of this ink supply path 21. Ink can thus be supplied to the inkjet head units 5(1) to 5(5) from an ink tank (not shown in the figures) by way of the ink tube 23 and ink supply path 21.

Figure 2A:
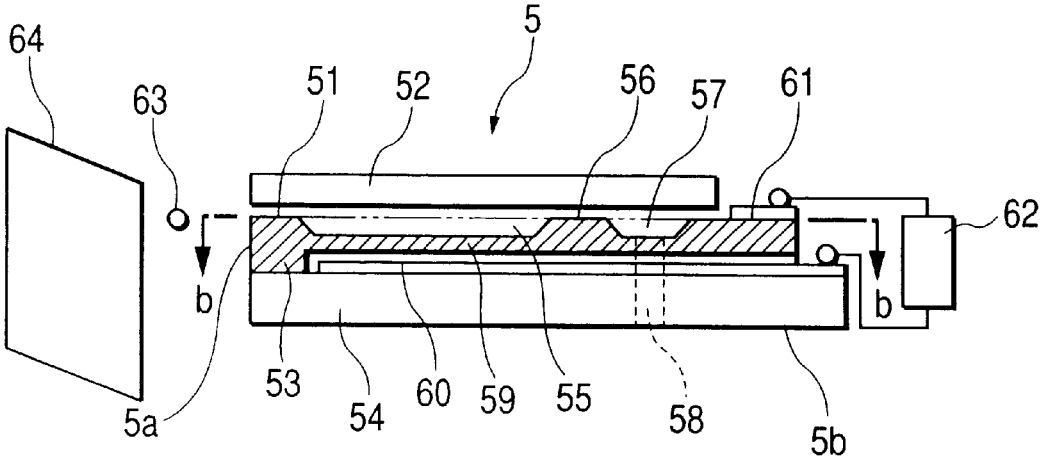
FIG. 2(*a*) is a section view of an ink jet head unit shown in FIG. 1, and FIG. 2(*b*) is a section view through line b—b in FIG. 2(*a*).
Figure 2B:
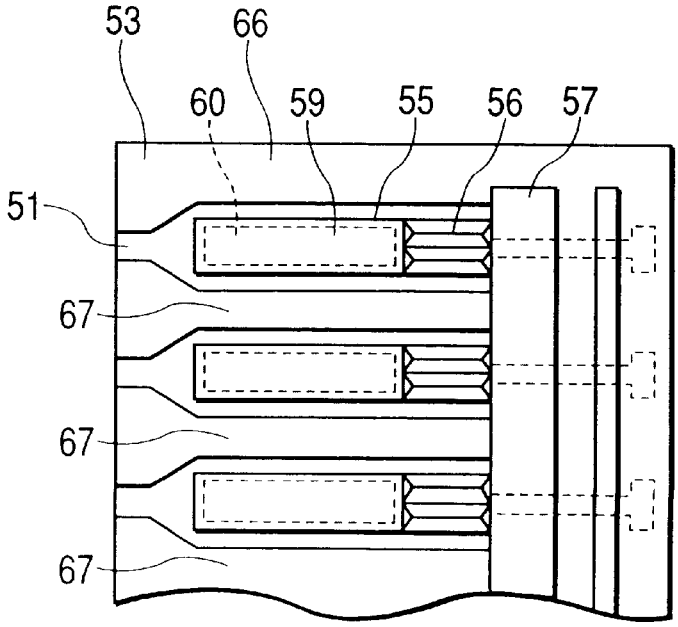

FIG. 2(*a*) and (*b*) show the typical structure of ink jet head units 5(1) to 5(5). An ink jet head unit 5 according to this embodiment is an electrostatic drive type ink jet head in which electrostatic force is used to vibrate a diaphragm to change the volume of an ink chamber communicating with an ink nozzle, and thereby discharge an ink drop from the nozzle. A piezoelectric type device using a piezoelectric element can be alternatively used to change the volume of an ink chamber communicating with an ink nozzle, and thereby discharge an ink drop from the nozzle. Yet further alternatively, a heating element can be used to vaporize ink in an ink chamber communicating with the nozzle, thereby changing the volume and causing an ink drop to be discharged.

Using an electrostatic drive type of ink jet head unit 5 makes it possible to suppress heat generation and power consumption by the ink jet head unit 5. Moreover, there are substantially no power consumption or heat generation issues with the electrostatic drive type of ink jet head unit 5, which is thus particularly well suited to use with a line ink jet head of the present invention in which the number of driven ink nozzles per ink jet head can be great.

As shown in FIG. 2(*a*) and (*b*), an ink jet head unit 5 according to this preferred embodiment of the invention comprises a silicon top plate 52 and a bottom glass plate 54 with a silicon cavity plate 53 disposed therebetween in a three layer laminated construction.

The ink nozzles 51 are formed in the ink nozzle surface 5*a* (front surface) in line in a direction orthogonal to the paper surface. Each ink nozzle 51 is linked to an ink pressure chamber 55. Each ink pressure chamber 55 communicates with the common ink chamber 57 by way of a small diameter ink supply opening 56. The common ink chamber 57 communicates with the common ink supply path 21 of the head unit mounting layer 2 by way of an ink supply port 58 passing through glass plate 54.

The bottom wall of each ink pressure chamber 55 is a flexible diaphragm 59 perpendicularly displaceable to the surface. An individual electrode 60 is formed on the surface of the glass plate 54 opposing each diaphragm 59. A common electrode 61 is formed in the cavity plate 53. A drive voltage pulse signal is applied by head driver 62 between the common electrode 61 and individual electrode 60 of the nozzle to be driven. This applied voltage generates an electrostatic force (attraction) between the diaphragm 59 and individual electrode 60, which are disposed with a slight gap therebetween. This electrostatic force causes the diaphragm 59 to deflect (flexibly displace). When the applied voltage is then cancelled, the diaphragm 59 flexibly returns. These forces of electrostatic attraction and flexible restoration vary the volume of the ink pressure chamber 55 and cause an ink drop 63 to be expelled from the ink nozzle 51 to the printing paper 64.

A line ink jet head 1 according to this embodiment is installed to a printer as described further below. As paper 64, that is, the print medium, is advanced through the printer, a drive voltage pulse signal is applied from the head driver 62 synchronized to the advancement of paper 64 to print to the paper 64. The print medium is not limited to paper 64, and can be such other media as printable sheets, seals, or labels, tags, and tickets. With a line ink jet head 1, the print medium can be appropriately selected according to the application of the printed content.

Figure 3:
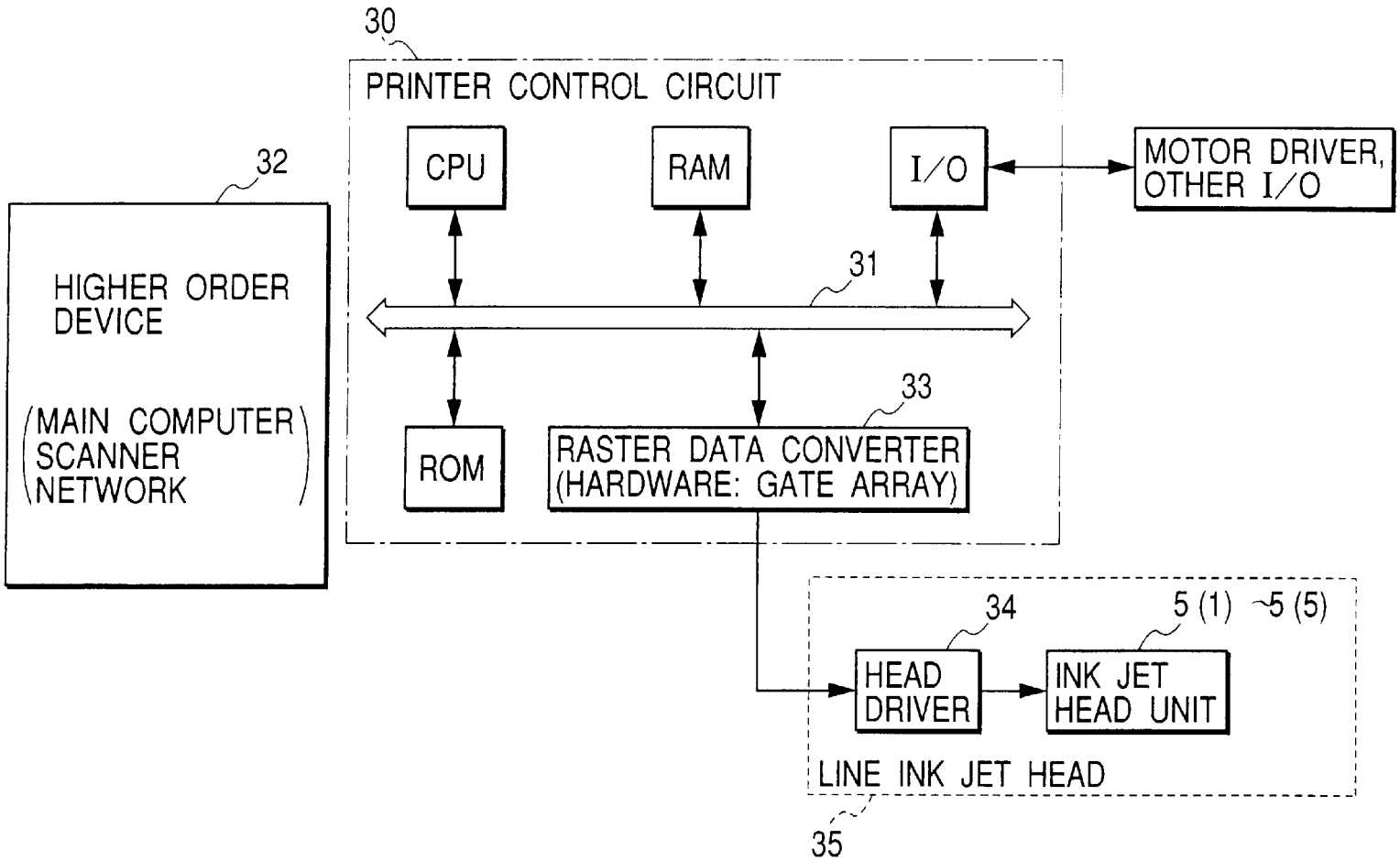
FIG. 3 is a block diagram of an embodiment of a control circuit in a printer.

FIG. 3 is a block diagram showing the control circuit 30 of a printer 150 in this preferred embodiment of the invention. Area 35 in a dotted line in FIG. 3 is a block diagram of the control circuit for a line inkjet head. The printer control circuit 30 can be achieved using a microprocessor with various processes being achieved by means of the operations of a CPU. More specifically, necessary control programs can be stored in a ROM or other nonvolatile storage device. Programs read from ROM are then run using RAM as working memory to accomplish the control operations. These components are interconnected by way of an internal bus 31. Operating results are output to the motor driver and other peripheral devices by way of input/output port I/O. The printer control circuit 30 is also connected to a higher order computer 32 from which the print image (data) is supplied as a rasterized bit image.

Line ink jet head 35 comprises the above-described ink jet head units 5(1) to 5(5) and corresponding head drivers 34. Head drivers 34 are connected 1:1 to the ink jet head units 5(1) to 5(5). A drive voltage pulse is applied appropriately from a head driver 34 to the corresponding ink jet head unit 5 to discharge an ink drop from the ink nozzle.

The rasterized bit image data is converted by a raster data converter 33, which is a gate array, to raster data appropriate to the arrangement of the ink jet head units 5(1) to 5(5) and ink nozzle arrangement of the line ink jet head 35. The raster data is then supplied to the head drivers 34 and ink jet head units 5(1) to 5(5) of the line ink jet head 35.

This rasterized bit image is a data structure in which the data is arranged perpendicularly to the direction of paper 64 transport, that is, in the data scan direction. The 8-bit data blocks that are the data processing unit are arranged in the data scanning direction from the MSB to LSB. Each byte of data, that is, each data processing unit, is thus converted by the raster data converter 33 to a separate raster data array according to the ink jet head units 5(1) to 5(5) of the line ink jet head 35.

As described with reference to FIG. 1, the distance t between the center lines L1 and L2 of the ink nozzles arrayed in two staggered rows is an integer multiple of the nozzle pitch p. It is therefore possible without requiring a special delay circuit and using minimal memory for the data conversion operation to convert raster bit image data to a raster data array suitable for driving the ink nozzles of the ink jet head units 5(1) to 5(5) of the line ink jet head 35 by means of a data conversion operation accomplished with a simple hardware design. As described above, the inkjet head units 5(1) to 5(5) of a line inkjet head 1 according to this preferred embodiment of the invention are disposed in two staggered rows with a head unit mounting layer 2 therebetween.

By precisely manufacturing the head unit mounting layer 2 to a constant layer thickness, that is, a precise distance between head unit mounting surfaces 3 and 4, and precisely manufacturing each ink jet head unit so that the distance from the back 5i b,that is, the reference surface for ink jet head unit mounting, to the ink nozzle 51 is constant, it is therefore possible to precisely position staggered ink jet head units 5(1) to 5(5) by simply bonding ink jet head units 5(1) to 5(5) to the head unit mounting surfaces 3 and 4.

Furthermore, the nozzle pitch p between the ink nozzles of staggered adjacent ink jet head units can also be made identical to the pitch p between other ink nozzles without making the thickness of the end walls 66 of the ink jet head units thinner than the interior ink chamber dividing walls 67. The ink discharge characteristic of the end ink nozzles of each ink jet head unit can therefore be kept identical to the ink discharge characteristic of the interior ink nozzles. Good print quality can therefore be maintained.

Manufacturing is therefore made easier because it is not necessary to precisely process the end walls of the ink jet head units as it is with the prior art when the ink jet head units are arranged in a single line.

Yet further, the distance t between the center lines L1 and L2 of the ink nozzles arrayed in two staggered rows is an integer multiple of the nozzle pitch p. It is therefore possible to easily control the drive timing required to match the print position of the ink jet head units on one side to the print position of the ink jet head units on the other side. The ink jet head units can therefore be driven to achieve high print quality using a drive circuit of simple design.

The effects and benefits of the present embodiment can be achieved when the center line distance t between ink nozzles is any positive integer multiple of the base resolution of the image printed by a printer in which a line ink jet head according to the present invention is used.

The base image resolution as used herein is equivalent to the pitch between the ink nozzles of the line ink jet head 1 in the data scan direction; in the print medium transportation direction, it is the distance obtained by multiplying the shortest period at which ink drops can be continuously discharged from any same nozzle of the line ink jet head with the print medium transportation speed.

In this embodiment, the printer prints at a base resolution of 1/360 inch (360 dpi) in the data scan direction and the print medium transportation direction. In addition, the common ink supply path 21 is disposed in the head unit mounting layer 2 between the odd and even ink jet head units 5.

To assure a size sufficient to prevent deficient ink drop discharge, the ink supply path 21 must have a 7.5 mm internal diameter. The head unit mounting layer 2 is therefore 8.5 mm thick, the thickness required to achieve a stable shape by injection molding. The inkjet head unit 5 is 0.5 mm thick. This means that the drive circuit can be simplified if the shortest distance t between the ink nozzle center lines is greater than sum of the thickness of the head unit mounting layer 2 and the thickness of the ink jet head unit 5, thus 8.5 mm+0.5 mm=9.0 mm. In this case, the distance t is set at 16/45 inch or approximately 9.03 mm, which is 128 times as large as the base resolution as the smallest integer multiple of the base in a range larger than 9.0 mm.

Embodiment 2

Figure 4:
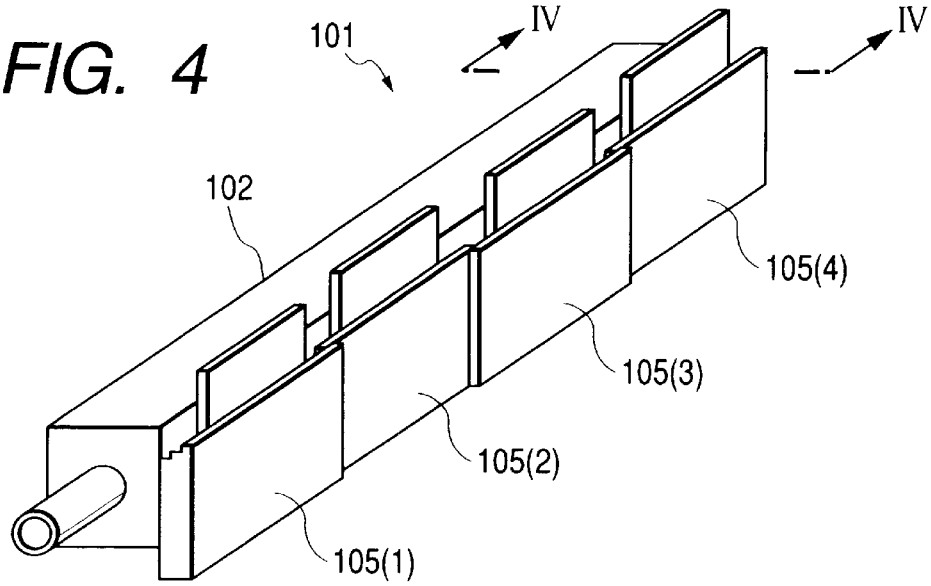
FIG. 4 is a perspective view of an embodiment of a line ink jet head.
Figure 5:
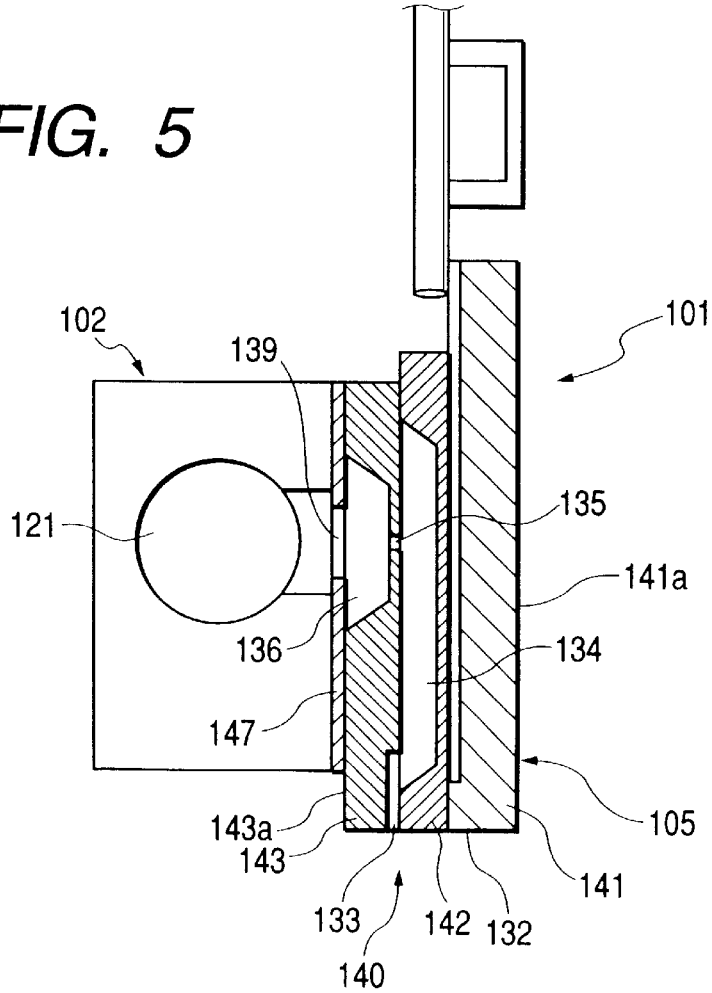
FIG. 5 is a section view through line IV—IV in the line ink jet head shown in FIG. 4.
Figure 6:
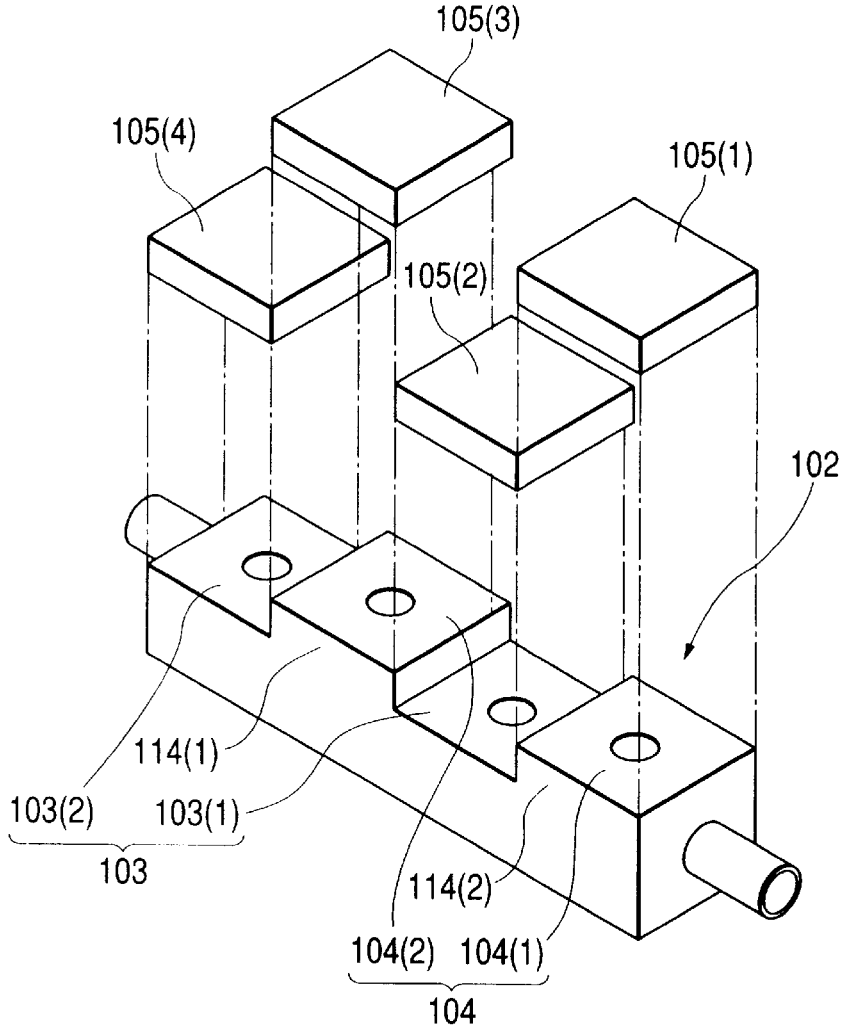
FIG. 6 is a perspective view of a head unit mounting layer in the line ink jet head shown in FIG. 4.

Another embodiment of a line ink jet head is described next below with reference to FIGS. 4 to 6. FIG. 4 is a perspective view showing the overall configuration of this line ink jet head, FIG. 5 is a section view through line IV—IV in FIG. 4, and FIG. 6 is a perspective view of the head unit mounting layer.

As shown in FIG. 4, a line ink jet head 101 according to this embodiment comprises a head unit mounting layer 102, first and second head mounting surfaces 103 and 104 formed on a same side of the head unit mounting layer 102, two ink jet head units 105(2) and 105(4) mounted on the first head mounting surface 103, and two ink jet head units 105(1) and 105(3) mounted on the second head mounting surface 104.

A common ink supply path 121 is formed lengthwise internally to the head unit mounting layer 102. Ink is supplied from an external source through this common ink supply path 121 to the ink jet head units 105(1) to 105(4).

The first and second head mounting surfaces 103 and 104 are formed as follows in this head unit mounting layer 102. The first head mounting surface 103 comprises two mounting surfaces 103(1) and 103(2) formed at a specific interval on one flat surface of the head unit mounting layer 102, which has a long narrow rectangular contour. Protrusions 114(1) and 114(2) project a specific distance from the surface of the head unit mounting layer 102 between these two mounting surfaces 103(1) and 103(2). The second head mounting surface 104 is defined by the surfaces 104(1) and 104(2) of these protrusions 114(1) and 114(2). The first head mounting surfaces 103(1) and 103(2) are positioned on a same plane, and the second head mounting surfaces 104(1) and 104(2) are likewise mounted on a same plane. Note that these two planes are different planes.

The ink jet head units 105(1) to 105(4) (referred to collectively as ink jet head unit 105 below) can be electrostatic drive type devices identical to the ink jet head units 5 of the line ink jet head 1 according to an embodiment as described above with reference to FIG. 1 to FIG. 3. To reduce its size, particularly in the front-back direction, an ink jet head unit 105 according to this preferred embodiment of the invention is designed as described below.

Referring primarily to FIG. 5, this ink jet head unit 105 has a plurality of ink nozzles 133 arrayed in line along the width of the head (vertically as seen in FIG. 5) at the ink nozzle surface 132, that is, the front of the ink jet head unit 105. Each ink nozzle 133 communicates with an ink pressure chamber 134 formed to the back of the head relative to the front ink nozzle surface 132. The ink pressure chambers 134 are likewise disposed along the width of the ink jet head unit 105 with a divider separating adjacent ink pressure chambers 134. Each ink pressure chamber 134 communicates with a common ink chamber 136 by way of respectively intervening ink supply ports 135. The common ink chamber 136 is laminated to the ink pressure chamber 134 in the head thickness direction. Ink is supplied from the common ink supply path 121 internal to the head unit mounting layer 102 to the common ink chamber 136 by way of intervening ink intake opening 139.

An electrostatic drive mechanism independently varies the volume of each ink pressure chamber 134 to change the internal pressure and thereby discharge an ink drop 140 from the corresponding ink nozzle 133.

An ink jet head unit 105 thus comprised can be achieved with a three layer structure comprising a glass electrode layer (third substrate) 141, a cavity layer (second substrate) 142 bonded to the surface of the glass electrode layer 141, and a nozzle layer (first substrate) 143 bonded to the surface of the cavity layer 142. The cavity layer 142 and nozzle layer 143 are made from silicon single crystal substrates.

Bonding cavity layer 142 and nozzle layer 143 together forms ink nozzles 133 and ink pressure chambers 134 therebetween with each ink nozzle 133 communicating with a corresponding ink pressure chamber 134. A plurality of ink supply ports 135 (two in this exemplary embodiment) is also open in a back end part of each ink pressure chamber 134. A film 147 having ink intake openings 139 formed therein is bonded between the head unit mounting surfaces (103 or 104) of the head unit mounting layer 102 and the surface of nozzle layer 143. The common ink chamber 136 formed in the surface of nozzle layer 143 communicates with the common ink supply path 121 by way of ink intake opening 139 in film 147.

An electrostatic drive mechanism for discharging ink drops from each ink nozzle 133 is formed between the cavity layer 142 and glass electrode layer 141. This drive mechanism is the same as described in the first embodiment above, and further description thereof is thus omitted below.

The common ink chamber 136 of an inkjet head unit 105 according to this embodiment is laminated to the ink pressure chamber 134. The front-back length of the ink jet head unit 105 can therefore be shortened compared with the design of an ink jet head unit shown in FIG. 2 in which the common ink chamber and ink pressure chamber are formed on the same plane.

In addition, the reference surface for mounting the ink jet head unit to the first and second head mounting surfaces 103 and 104 is surface 143*a* of the silicon single crystal nozzle layer 143. It is therefore possible to precisely control the distance from first and second head mounting surfaces 103 and 104 to ink nozzle 133 by simply precisely controlling the thickness of the nozzle layer 143. It is therefore extremely simple to precisely position the mutually staggered ink jet head units to each other.

Surface 143*a* of nozzle layer 143 is the reference surface for mounting line ink jet head unit 101 according to this embodiment, but surface 141*a* of glass electrode layer 141 can alternatively be used as this reference surface.

Furthermore, the ink jet head unit 105 of this embodiment is a three layer laminated construction as described above with the common ink chamber 136 and a nozzle groove for ink nozzle formation formed in the nozzle layer 143. It is therefore not necessary to add a further separate layer to this assembly to layer the common ink chamber 136 over the ink pressure chamber 134. An increase in head thickness resulting from layering the common ink chamber to the ink pressure chamber can thus be minimized. An ink jet head unit that is small overall can thus be achieved. Manufacture is also easy because of the small number of parts.

The ink supply ports 135 are also formed perpendicularly to the bottom wall part of the common ink chamber in the nozzle layer 143, that is, in the thickness direction. It is easier to form the ink supply ports 135 in this manner compared with the common ink chamber being on the same plane as the ink pressure chamber. It is also possible to freely form a plurality of ink supply ports 135. As a result, the ink discharge characteristic of the ink jet head unit can be easily adjusted.

Figure 7:
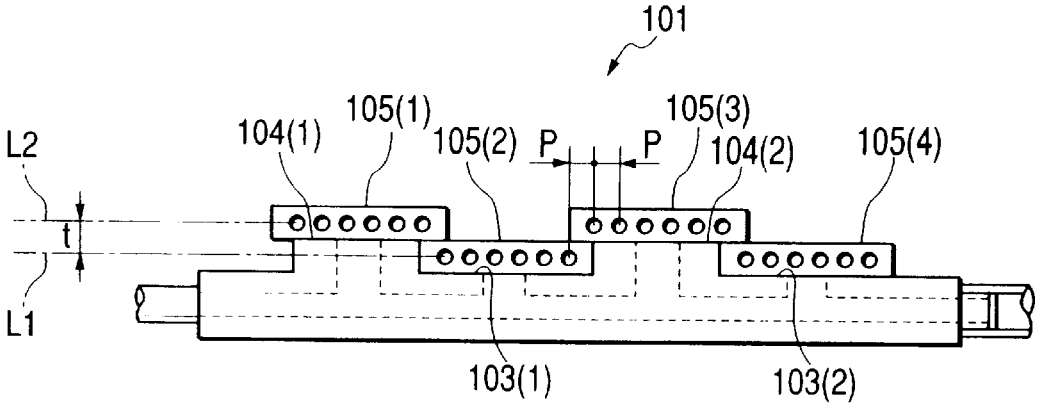
FIG. 7 is a further descriptive diagram of the line ink jet head shown in FIG. 4.

Next, as shown at units 105(2) and 105(3) in FIG. 7, the ink jet head units are also positioned in this embodiment so that the nozzle pitch between the end nozzles of staggered adjacent ink jet head units is identical to the nozzle pitch p between the other ink nozzles. In addition, the distance t between center lines L1 and L2 through the ink nozzles of the ink jet head units mounted to the first head mounting surface 103 and the ink nozzles of the ink jet head units mounted to the second head mounting surface 104, respectively, is also an integer multiple of the nozzle pitch p.

It is therefore possible for a line ink jet head 101 according to this preferred embodiment of the invention to achieve the same benefits obtained with the line ink jet head 1 shown in FIG. 1 to FIG. 3.

In addition, distance t in a line ink jet head 101 according to this embodiment can be made less than the smallest distance t in the line ink jet head 1 described above. A smaller line ink jet head can therefore be achieved, and the amount of memory required for data processing when printing can also be reduced.

For example, if a line ink jet head 101 according to this embodiment is used in a printer that prints with a base resolution of 1/360 inch, distance t can be set to eight times the base resolution or 1/45 inch (approximately 0.556 mm). Unlike the above described line ink jet head 1, a line ink jet head 101 according to this preferred embodiment does not require a common ink supply path 21 between odd and even ink jet head units 105(1) to 105(4). As a result, it is only necessary to provide a step as low as 0.5 mm or more, that is, the thickness of the ink jet head unit 105, between the head unit mounting surfaces.

The drive circuitry can also be simplified and the smallest possible ink jet head can be achieved by using an ink nozzle center line distance t of only eight times the base resolution. Moreover, printing speed can be increased and paper 64 can be used more efficiently compared with a line ink jet head 1 according to the first embodiment because this ink nozzle center line distance t is shorter.

Alternative embodiment of ink jet head unit 101

Figure 8A:
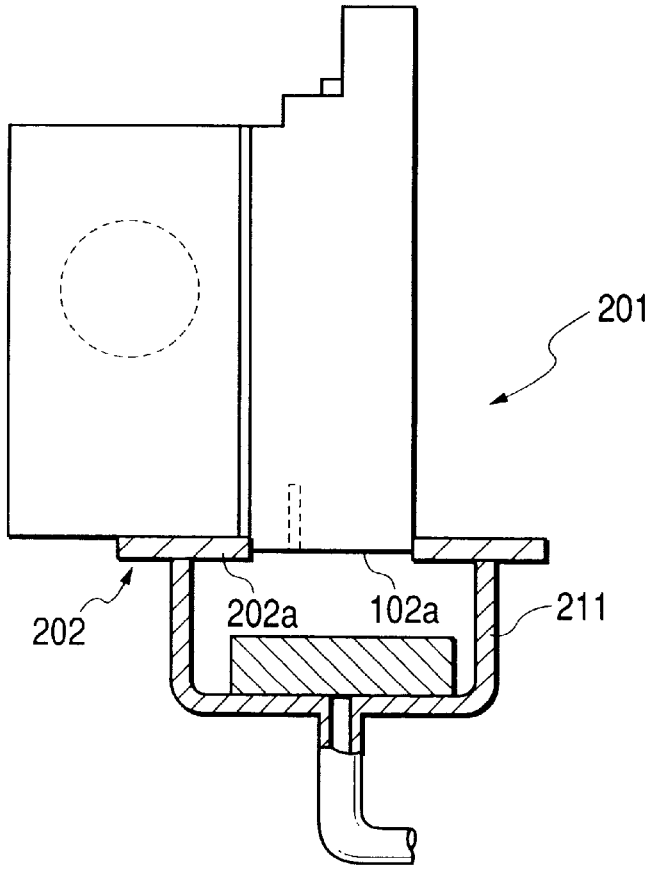
FIG. 8(*a*) is a descriptive view of an alternative version of the line ink jet head shown in FIG. 4, and FIG. 8(*b*) shows the outline of a cap for the staggered ink jet head units shown in FIG. 4.
Figure 8B:
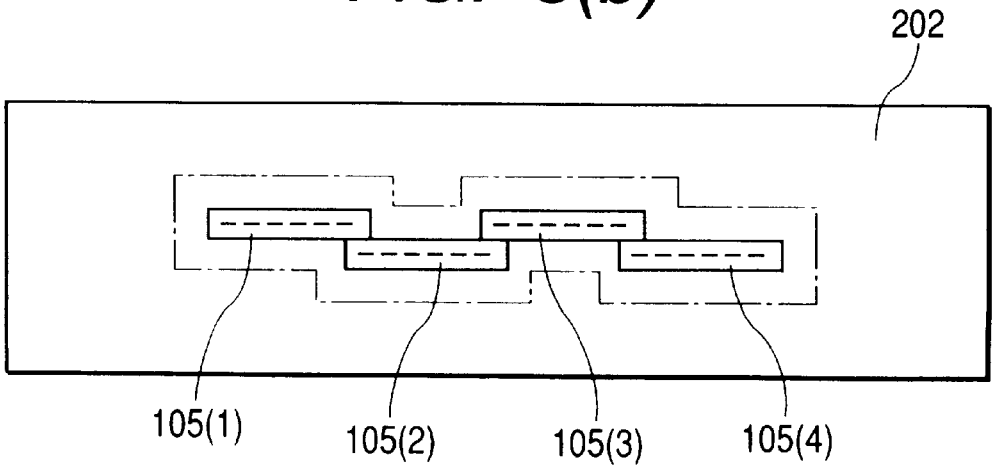
Figure 9:
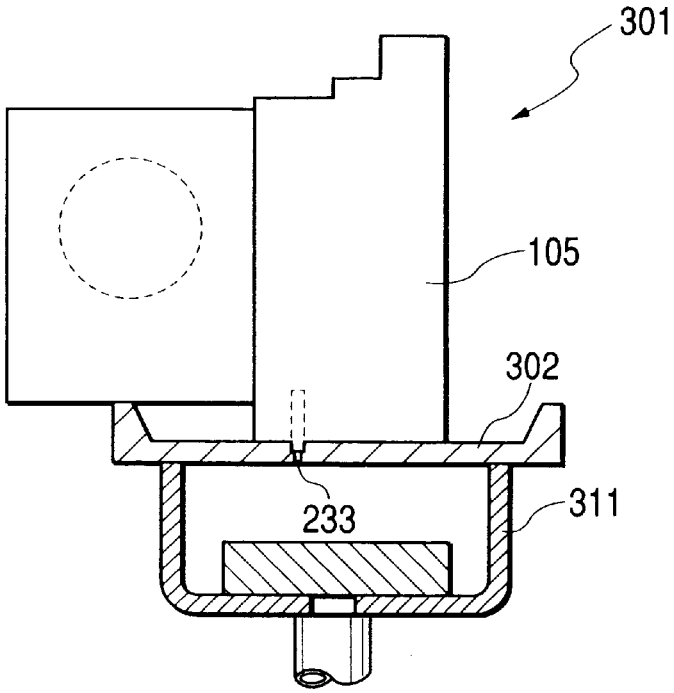
FIG. 9 is a descriptive view of an alternative version of the ink jet head unit shown in FIG. 4.

An alternative embodiment of this line ink jet head 101 is shown in FIG. 8 and FIG. 9. The ink jet head unit 201 of the line ink jet head shown in FIG. 8(*a*) has a plate 202 attached to the ink nozzle surface 102*a*. Plate surface 202*a* protrudes slightly forward of ink nozzle surface 102*a*. The ink nozzle surface 102*a* is protected by this plate 202.

This plate surface 202*a* can be the same surface as the ink nozzle surface 102*a*. Because there is no step to the ink nozzle surface 102*a* in this case, ink and paper debris will not collect, and a factor contributing to lower print quality can be eliminated.

A cap 211 for capping all ink nozzles of the staggered ink jet head units 105(1) to 105(4) can be easily provided by thus disposing this plate 202. The internal shape of a cap conforming to the outline of the ink jet head units 105(1) to 105(4) is shown by the dot-dash line in FIG. 8(*b*). The cap recess can also be a rectangle or other alternative shape.

The internal volume of the cap 211 can be minimized by configuring the cap recess as shown in FIG. 8(*b*). This effectively prevents evaporation of the ink solvent from the ink nozzles, and can thus improve print quality.

Molding the cap is easier, and a lower cost cap can therefore be achieved, by configuring the cap 211 with a rectangular recess covering all ink nozzles.

The ink jet head unit 201 according to this alternative embodiment, and a line ink jet head comprising a plurality of these ink jet head units 201 in a staggered arrangement, are otherwise identical to those shown in FIGS. 4 to 7.

With a line ink jet head unit 301 as shown in FIG. 9 the ink nozzles 233 are formed as through-holes in a separate nozzle layer 302 that is bonded to the front surface of the head unit. This makes it easy to control ink nozzle characteristics while also enabling a cap 311 to be easily disposed for covering the complete staggered ink nozzle array.

The ink jet head unit 301 according to this alternative embodiment, and a line ink jet head comprising a plurality of these ink jet head units 201 in a staggered arrangement, are otherwise identical to those shown in FIGS. 4 to 7.

A further alternative embodiment

Figure 10:
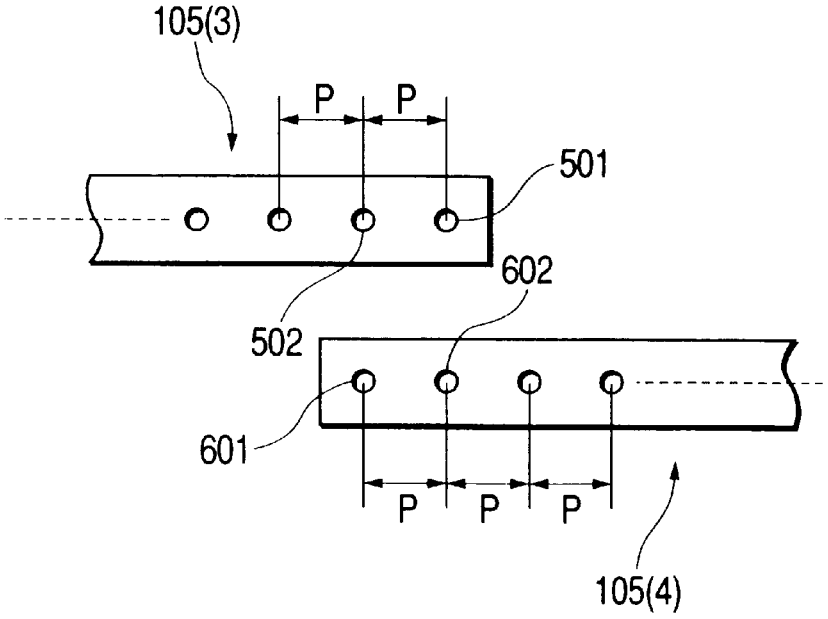
FIG. 10 shows a further alternative alignment of the staggered ink jet head units in a line ink jet head shown in FIG. 4.

The staggered adjacent inkjet head units can be alternatively arranged as described below. Referring to FIG. 10, the endmost ink nozzle 501 of a first ink jet head unit 105(3) is aligned with the second ink nozzle 602 of the adjacent ink jet head unit 105(4) offset from the first inkjet head unit 105(3). This means that the next-adjacent ink nozzle 502 of the first ink jet head unit 105(3) is aligned with the endmost ink nozzle 601 of the same other ink jet head unit 105(4).

The endmost ink nozzle of both ink jet head units 105(3) and 105(4) can therefore be handled as unused nozzles. Ink drops to be discharged from the endmost ink nozzle can be discharged from the second ink nozzle of the adjacent ink jet head. The ink path and the thickness of the wall separating the driven nozzle used for printing from the adjacent driven ink nozzle are identical to those of every other ink nozzle used for printing. A drop in print quality can therefore be prevented when the ink discharge characteristic of the end ink nozzles of the inkjet head units 105(3) and 105(4) differs from the discharge characteristic of the other ink nozzles because these end ink nozzles are not used for printing.

A printer embodiment

Figure 11:
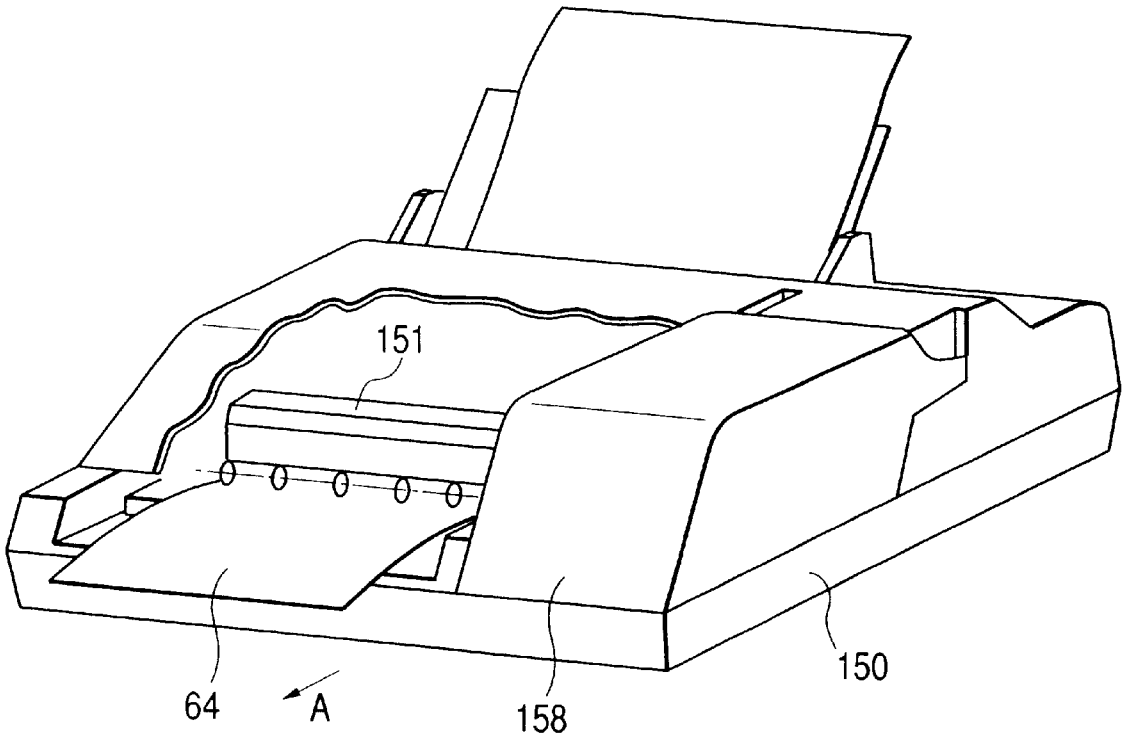
FIG. 11 is an oblique view showing the appearance of an embodiment of a printer.
Figure 12:
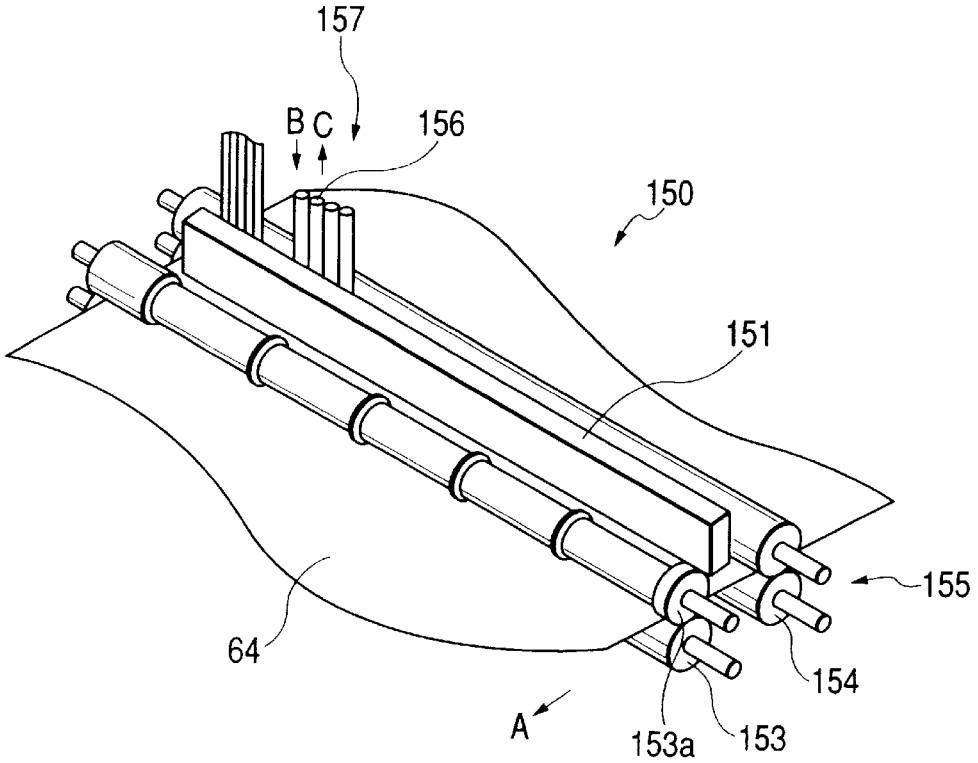
FIG. 12 shows the major components of the printer shown in FIG. 11.
Figure 13:
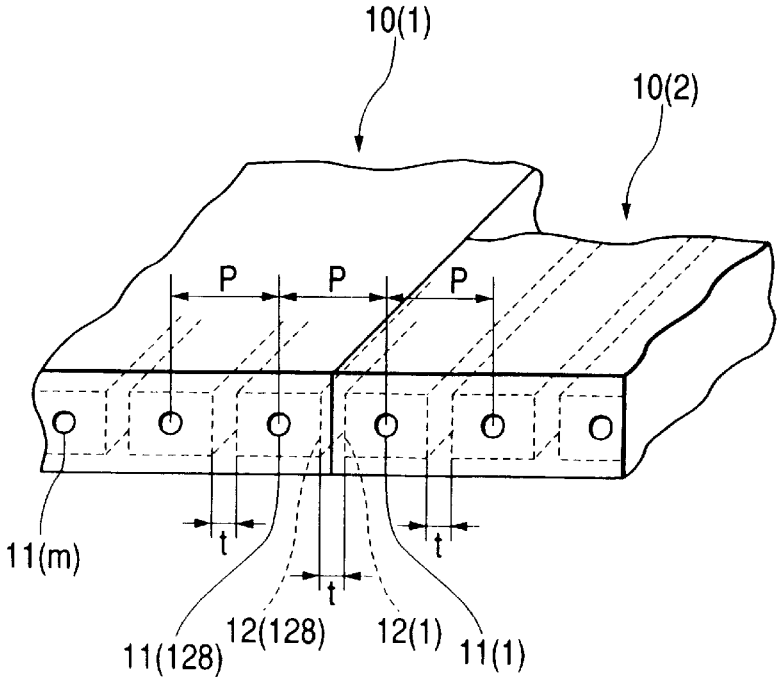
FIG. 13 illustrates a line ink jet head.

FIG. 11 is a perspective view of a printer according to an embodiment. FIG. 12 is a perspective view showing the essential components of the printer shown in FIG. 11. A line ink jet head 151 is used in this printer 150.

Referring to FIG. 11, printer 150 advances paper 64 in the direction of arrow A, and discharges ink drops from the line ink jet head 151 synchronized to the speed of paper 64 transport to print. An ink supply mechanism 157 is stored in housing 158.

The ink supply mechanism 157 comprises an ink tank for holding ink (not shown in the figures), an ink circulating pump (not shown in the figures) for sending ink to the line ink jet head 151 and simultaneously recovering ink therefrom, and an ink pipe 156 disposed between the ink tank, ink circulating pump, and line ink jet head 151. These are housed in the ink supply mechanism housing 158.

The printer 150 further comprises a control circuit section as shown in FIG. 3. This control circuit controls driving the line inkjet head 151, form transportation mechanism 155, and ink supply mechanism 157, and handles data communication with a scanner, network, or other higher order device.

As shown in FIG. 12, the major components of the printer 150 include a line ink jet head 151 arrayed to cover the available printing area; form transportation mechanism 155; and ink supply mechanism 157. The form transportation mechanism 155 includes a feed roller 154 for transporting the paper 64 passed the printing position of the line ink jet head 151, and a presser roller 153 for holding the paper 64. The ink supply mechanism 157 includes the ink pipe 156 for supplying ink to the line ink jet head 151.

A cap 211 (not shown in the figure) positioned opposite the ink nozzles of the line ink jet head 151 so that it can be moved to cover and uncover the ink nozzle surface, and a means for so moving the cap, are further disposed to the printer 150.

Paper 64 is thus transported in the direction of arrow A by means of feed roller 154 and presser roller 153 of the form transportation mechanism 155 in this main part of the printer 150.

The presser roller 153*a* near the line ink jet head 151 presses the paper 64 against the opposing roller to keep the paper 64 taut and prevent it from contacting the nozzle surface of the line inkjet head 151 so that the printed image does not become blurred or smudged.

The presser roller 153*a* has surface ridges to minimize the surface area that contacts paper 64. This is to prevent blurring or smudging the printed image as a result of contact between the roller and paper before the ink deposited on the paper 64 can dry or be absorbed by the paper 64.

At a timing controlled according to the speed at which the form transportation mechanism 155 advances the paper 64 (referred to as the form speed below), a printer thus comprised discharges ink drops from the form transportation mechanism 155 to print letters or an image on the paper 64. The form speed is detected by a detection mechanism (not shown in the figures) disposed to the form transportation mechanism 155 detecting the angle of rotation and speed of the feed roller 154. The controller then controls the head drive timing according to this detected form speed to discharge ink from the line ink jet head and print. Sharp, high quality printing can thus be achieved at high speed.

Printing is completed in conjunction with advancing the paper 64, and a printer according to the present invention can thus achieve extremely high speed printing. For example, at the same base resolution of 1/360 inch (360 dpi) described above, the paper 64 can be advanced and printed at approximately 564 mm/sec if the line ink jet head 151 is driven at a maximum drive frequency of 8 kHz. A printer can therefore achieve extremely high speed printing. This means that an on-demand printer or on-demand ticket printer capable of high speed printing can be provided by means of the present invention.

Ink is supplied to the line ink jet head 151 from ink pipe 156. Two of the four ink pipes 156 supply ink in the direction of arrow B from the ink tank of ink supply mechanism 157 to the line ink jet head 151. Ink is circulated and recovered by way of the circulating pump to the ink tank through the remaining other two ink supply pipes 156.

By thus providing a circulating ink supply path to the line ink jet head 151 it is possible to efficiently charge the common ink supply path 121 of the line ink jet head 151 with ink, purge bubbles from the ink in the common ink supply path 121 and thereby remove a cause of defective ink discharging. Ink is thus not wasted in the operations for charging the ink supply mechanism 157 with ink and purging bubbles therefrom. Ink not used for printing is thus not used unnecessarily.

When the printer is not in use the cap 211 covers the ink jet head unit. When a signal for driving the ink nozzles is received, ink drops evacuated from the ink nozzles in preparation for printing before the paper 64 is advanced to the ink jet head are also received into the cap.

The cap 211 then moves down in the direction below of FIG. 12 to retract from the paper 64 path.

When a specific time in which no printing occurs elapses and there is no paper 64 between the cap and nozzles, the cap moving means is driven by a command from the controller to move the cap 211 to a position covering and protecting the nozzles. The cap 211 is further connected by a tube to the pump unit (not shown in the figures) to appropriately purge any ink in the cap 211. When the cap is covering the ink nozzles, the circulating pump can also be driven to purge any ink that has increased in viscosity due to extended non-use from the nozzles of the line ink jet head 151.

It is further advantageous to provide a means for cleaning and removing paper debris, dust, and other foreign matter from the nozzle surface. An exemplary cleaning means is a wiping mechanism, which can be disposed near the cap 211 at a position opposite the nozzle surface for wiping the nozzle surface of the line ink jet head 151 and removing such debris.

As noted above, an embodiment of a printer prints to the print medium by means of the line inkjet head while moving the print medium passed the line inkjet head. The printer configuration is therefore simple, the printer is easy to manufacture, and a printer in which the time needed for printing is very short can be provided without complicating the drive circuit.

As described above, a line ink jet head has a head unit mounting layer comprising a plurality of head unit mounting surfaces for disposing the ink jet head units in a staggered pattern. It is therefore possible by precisely manufacturing the head unit mounting surfaces and simply bonding the ink jet head units to these head unit mounting surfaces to precisely position the ink jet head units to each other in a staggered pattern. It is therefore possible to sustain high print quality with a line inkjet head comprising a plurality of ink jet heads in a staggered arrangement.

The distance between ink nozzle lines in the staggered ink jet heads is an integer multiple of the base resolution of the printed image. By thus controlling the distance between the ink nozzle lines, a simple control circuit can be used for adjusting the drive timing of the staggered ink jet head units.

A number of embodiments of the invention have been described. Nevertheless, it will be understood that various modifications may be made without departing from the spirit and scope of the invention. Accordingly, other embodiments are within the scope of the following claims.

What is claimed is:

1. A line ink jet head, comprising:

a plurality of head units, each unit having a nozzle surface in which ink nozzles are formed substantially in a line and a reference surface being orthogonal to the nozzle surface and parallel to the direction of the ink nozzle line;

a base plate having first and second surfaces arranged in a staggered pattern in the direction of the ink nozzle line, said head units being attached to said first and second surfaces, wherein a distance between offset ink nozzle lines in the staggered head units is an integer multiple of a base resolution of a printed image; and a common ink supply path formed in the base plate for supplying ink to each head unit.

2. A line ink jet head as described in claim 1, wherein the common ink supply path is disposed between the first surface and the second surface.

3. A line ink jet head as described in claim 2, wherein the head comprises an ink pressure chamber communicating with an ink nozzle, and an electrostatic actuator for changing a volume of the ink pressure chamber using electrostatic force to discharge ink drops from the ink nozzles.

4. A line ink jet head as described in claim 3, in which the head unit has laminated first, second, and third substrates bonded to each other, a common ink chamber communicating with the common ink path formed in the first substrate, the ink nozzles and ink pressure chamber formed between the first and second substrates, and the electrostatic drive mechanism formed between the second and third substrates;

wherein the side of the first substrate opposite the side thereof to which the second substrate is bonded, or the side of the third substrate opposite the side thereof to which the second substrate is bonded, is the mounting reference surface.

5. A line ink jet head as described in claim 1, wherein a distance between the offset ink nozzle lines in the staggered head units is an integer multiple of a nozzle pitch of the ink nozzles.

6. A line inkjet head, comprising:

a plurality of head units, each unit having a nozzle surface in which ink nozzles are formed substantially in a line and a reference surface being orthogonal to the nozzle surface and parallel to the direction of the ink nozzle line;

a base plate having first and second surfaces arranged in a staggered pattern in the direction of the ink nozzle line, wherein the second surface is defined by a protrusion protruding relative to said first surface, said head units being attached to said first and second surfaces; and a common ink supply path formed in the base plate for supplying ink to each head unit.

7. A line ink jet head as described in claim 6, wherein the head comprises an ink pressure chamber communicating with an ink nozzle, and an electrostatic actuator for changing a volume of the ink pressure chamber using electrostatic force to discharge ink drops from the ink nozzles.

8. A line ink jet head as described in claim 7, in which the head unit has laminated first, second, and third substrates bonded to each other, a common ink chamber communicating with the common ink path formed in the first substrate, the ink nozzles and ink pressure chamber formed between the first and second substrates, and the electrostatic drive mechanism formed between the second and third substrates;

wherein the side of the first substrate opposite the side thereof to which the second substrate is bonded, or the side of the third substrate opposite the side thereof to which the second substrate is bonded, is the mounting reference surface.

9. A line ink jet head as described in claim 8, wherein a distance between offset ink nozzle lines in the staggered head units is an integer multiple of a base resolution of a printed image.

10. A line ink jet head as described in claim 6, wherein a distance between offset ink nozzle lines in the staggered head units is an integer multiple of a base resolution of a printed image.

11. A line ink jet head as described in claim 6, wherein a distance between offset ink nozzle lines in the staggered head units is an integer multiple of a nozzle pitch of the ink nozzles.

12. A printer, comprising:

a line ink jet head, having a plurality of head units, each unit having a nozzle surface in which ink nozzles are formed substantially in a line and a reference surface being orthogonal to the nozzle surface and parallel to the direction of the nozzle line;

a base plate having first and second surfaces arranged in a staggered patter in the direction of the ink nozzle line, wherein the second surface is defined by a protrusion protruding relative to said first surface, said head units being attached to said first and second surfaces; and a common ink supply path formed in the base plate for supplying ink to each head unit;

a form transportation mechanism for transporting a print medium; and an ink supply mechanism for supplying ink to the line ink jet head;

wherein the line ink jet head is disposed covering a printing area of a print medium transported by the form transportation mechanism.

13. A printer as described in claim 12, wherein the head comprises an ink pressure chamber communicating with an ink nozzle, and an electrostatic actuator for changing a volume of the ink pressure chamber using electrostatic force to discharge ink drops from the ink nozzles.

14. A printer as described in claim 12, wherein a distance between offset ink nozzle lines in the staggered head units is an integer multiple of a base resolution of a printed image.

15. A printer as described in claim 12, wherein a distance between offset ink nozzle lines in the staggered head units is an integer multiple of a nozzle pitch of the ink nozzles.

* * * * *